US007352139B2

(12) United States Patent
Ribarich et al.

(10) Patent No.: US 7,352,139 B2
(45) Date of Patent: Apr. 1, 2008

(54) MULTIPLE LAMP BALLAST CONTROL CIRCUIT

(75) Inventors: Thomas J. Ribarich, Laguna Beach, CA (US); Zan Huang, Torrance, CA (US)

(73) Assignee: International Rectifier Corporation, El Segundo, CA (US)

( * ) Notice: Subject to any disclaimer, the term of this patent is extended or adjusted under 35 U.S.C. 154(b) by 255 days.

(21) Appl. No.: 11/056,748

(22) Filed: Feb. 11, 2005

(65) Prior Publication Data

US 2006/0186834 A1 Aug. 24, 2006

Related U.S. Application Data

(60) Provisional application No. 60/543,970, filed on Feb. 11, 2004.

(51) Int. Cl.
*H05B 39/00* (2006.01)

(52) U.S. Cl. ..... 315/312; 315/224; 315/244; 315/291

(58) Field of Classification Search ..... 315/291, 315/224, 307, 308, 209 R, 244, 194, 127, 315/247; 361/57, 79
See application file for complete search history.

(56) References Cited

U.S. PATENT DOCUMENTS 5,023,519 A * 6/1991 Jensen ..... 315/242
6,008,593 A * 12/1999 Ribarich ..... 315/307
6,016,257 A * 1/2000 Chang et al. ..... 363/17
6,031,342 A * 2/2000 Ribarich et al. ..... 315/291
6,326,740 B1 * 12/2001 Chang et al. ..... 315/291
6,362,575 B1 * 3/2002 Chang et al. ..... 315/224
7,061,118 B2 * 6/2006 Masuda ..... 257/774
7,109,665 B2 * 9/2006 Green ..... 315/224

* cited by examiner

*Primary Examiner*—Douglas W. Owens
*Assistant Examiner*—Chuc Tran
(74) *Attorney, Agent, or Firm*—Ostrolenk, Faber, Gerb & Soffen, LLP

(57) ABSTRACT

A ballast control circuit for multiple lamps comprising a ballast control circuit for driving two series connected switches of a lamp ballast connected across a supply potential and having a switched node between the switches; the switched node adapted to be connected to an output circuit comprising a plurality of parallel connected lamps; the control circuit comprising an oscillator, the output circuit comprising the plurality of parallel connected lamps including inductive and capacitive components and having a resonance frequency that is dependent on the number of lamps in the output circuit; a lamp output voltage being developed across the output circuit; further comprising a feedback circuit for controlling the oscillator whereby the oscillator sweeps from a first frequency above resonance to a lower frequency closer to resonance such that the output voltage increases to a potential above a lamp ignition threshold, thereby igniting at least one lamp; the feedback circuit controlling the oscillator whereby the oscillator frequency reduces each time a lamp ignites, causing the output voltage across the output voltage circuit to increase above the threshold, thereby igniting another of the lamps.

57 Claims, 6 Drawing Sheets

MULTIPLE LAMP BALLAST CONTROL CIRCUIT

CROSS-REFERENCE TO RELATED APPLICATIONS

This application claims the priority and benefit of U.S. Provisional Application Ser. No. 60/543,970, filed Feb. 11, 2004 entitled INSTANT START BALLAST CONTROL IC, the entire disclosure of which is hereby incorporated by reference.

BACKGROUND OF THE INVENTION

The present invention relates to a lamp ballast, in particular, to a lamp ballast for powering instant start fluorescent lamps. Further, the present invention allows a plurality of such instant start lamps to be driven by the ballast circuit of which the ballast control IC of the present invention is a part.

There is a need for simplified ballast control integrated circuits for controlling electronic ballasts. Electronic ballasts provide significant advantages over electromagnetic ballasts including greater efficiency and greater ability to control the lamps. There are a number of such electronic ballast control IC's on the market including the IR2157 and 2167 family of ballast control IC's. The 2157 family is a 16-pin device and the 2167 family is a 20-pin device. These devices include many functions and it is often desirable to provide a control integrated circuit which has fewer pins to thereby simplify circuitry and reduce costs. An example of such a ballast control integrated circuit is the IR2520D integrated circuit which is an adaptive ballast control integrated circuit having only eight pins.

There is a need for a ballast control integrated circuit for controlling multiple instant start fluorescent lamps and having a reduced number of pins and which thus allows a reduction in the complexity of the external circuitry and components connected to the control IC.

There is furthermore a need for an instant start fluorescent lamp ballast control integrated circuit.

There is furthermore a need for an instant start ballast control circuit which allows the control of a plurality of instant start lamps wherein the brightness level of the lamps is maintained constant regardless of the number (up to a maximum number) of lamps connected to the ballast control circuit and which maintains a constant brightness level when lamps are removed.

There is furthermore a need for a ballast control circuit that insures that all of the multiple lamps are ignited.

Furthermore, there is a need for such a ballast control circuit which prevents hard switching, and thus attendant damage to the ballast switches, in the event of lamp removal.

SUMMARY OF THE INVENTION

This application describes a multiple lamp ballast control circuit and integrated circuit for the control circuit. Compared to the conventional discrete design, the new ballast circuit combines greater performance with many protection features while maintaining a small size and low cost. The IC minimizes the board size and component count, yet allows the ballast circuit to drive multiple lamps, preferably with only one resonant inductor. The IC contains a constant voltage control circuit that ensures all lamps ignite, a non-ZVS (non-zero voltage switching) protection circuit to ensure that soft-switching of the power half-bridge is maintained to protect the half-bridge MOSFETs, and a constant current control circuit for minimizing the variation of the light output of each lamp when a lamp is removed or inserted.

The control IC includes a voltage-controlled oscillator (VCO) with a fixed internal minimum frequency. The frequency changes according to the voltage on the IC VCO pin with, for example, 0V corresponding to the maximum frequency and 5V corresponding to the minimum frequency. The control IC also includes a dual-signal feedback (FB) pin that senses both the resonant output voltage and the lamp current for igniting the lamps and keeps the current in each lamp controlled to a fixed level regardless of how many lamps are connected in the circuit. When the VCC voltage exceeds the internal positive-going UVLO (under-voltage lock out) threshold and the IC becomes enabled, the internal oscillator, the gate drive outputs HO and LO, and the half-bridge output VS, start oscillating at a maximum frequency of, in the illustrated embodiment, 2.5 times the minimum frequency. The VCO pin voltage is initially at 0V, which corresponds to the maximum frequency. An external capacitor CVCO at the VCO pin is then charged up slowly by an internal current source. The VCO voltage increases and the frequency sweeps by decreasing towards the minimum frequency. As the frequency decreases, the operating point moves towards the resonant frequency of the output circuit and the output voltage across the output capacitor CRES and the lamps increases, igniting the lamps.

Further, the invention includes a non-zero voltage detection circuit to guard against hard switching and attendant power switch damage.

Furthermore, the invention provides a current control circuit to maintain lamp current substantially constant in each lamp, even when a lamp is removed or added, thereby maintaining a substantially constant lamp brightness.

BRIEF DESCRIPTION OF THE DRAWINGS

Other features and advantages of the present invention will become apparent from the following description of the invention which refers to the accompanying drawings, in which.

DETAILED DESCRIPTION OF EMBODIMENTS OF THE INVENTION

Figure 1:
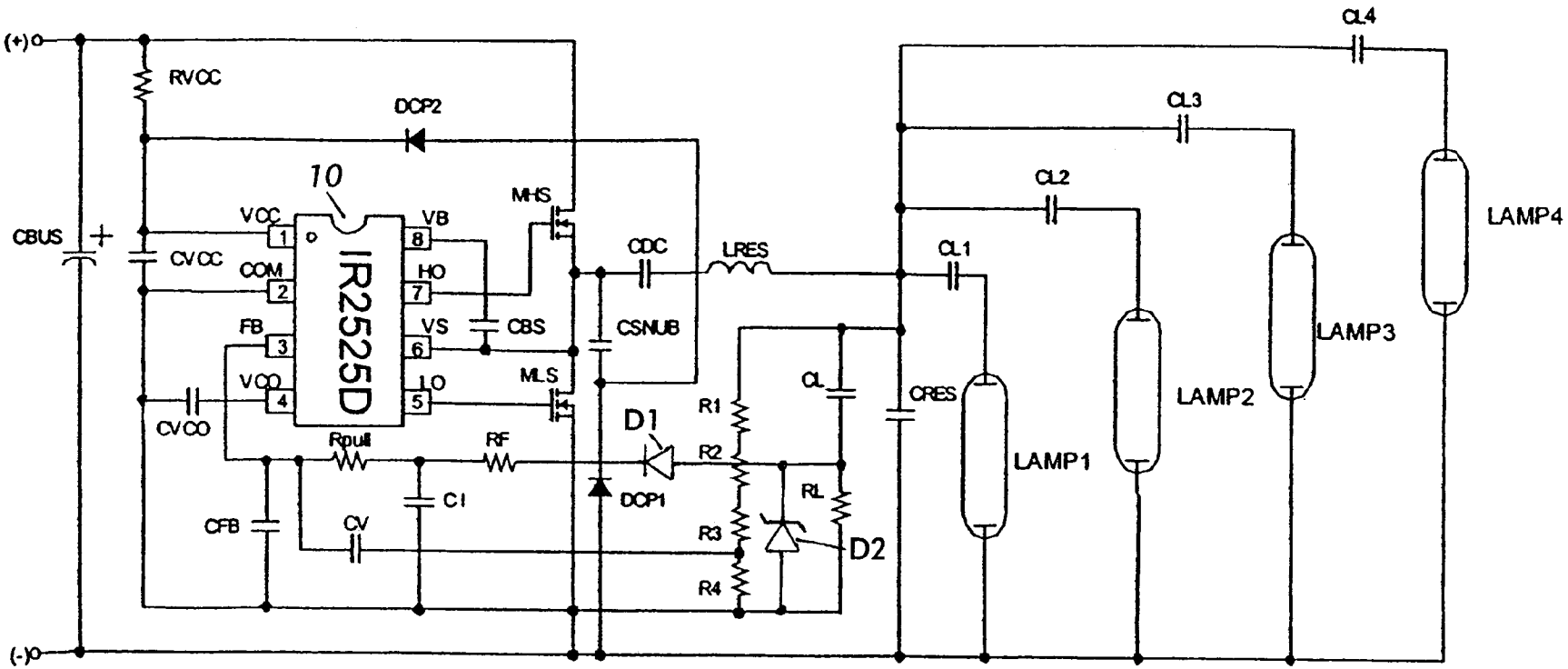
FIG. 1 shows a circuit diagram of a ballast including the ballast control integrated circuit according to the present invention.

With reference to the drawings, FIG. 1 shows a circuit diagram of a ballast control circuit according to the invention including the ballast control integrated circuit according to the present invention. The ballast control integrated circuit 10 is an eight-pin device having terminals VCC and COM for connection to the power supply. The resistor RVCC drops the supply voltage, which may typically be 200 to 600 volts, to the VCC level to power the control integrated circuit 10.

Terminals 5 and 7 of the IC provide the gate signals for the high side (MHS) and low side (MLS) ballast switching transistors coupled externally of the control integrated circuit 10. Terminal 6 comprises the switching node VS between the two external switching transistors and terminal 8 comprises a VB voltage source which is provided by a bootstrap capacitor CBS which charges, in known fashion, to a voltage VCC when transistor MLS is turned on. Bootstrap capacitor CBS provides a voltage source for the high side gate driver, in known fashion, rising to a voltage approximately VCC above the voltage VS when transistor MLS is off and transistor MHS is turned on. Diode DCP1 and DCP2 function as charge pumps in a known fashion.

The outputs HO and LO of the integrated circuit 10 comprise alternating pulsed signals for driving the switching transistors MHS and MLS in a complementary manner to provide a pulsed voltage at the frequency of the oscillator VCO to drive the discharge lamp 1, lamp 2, lamp 3 and lamp 4. Each lamp is driven through a series connected blocking capacitor CDC, a single inductance LRES and individual series resonance capacitors CL1, CL2, CL3 and CL4. A resonance output capacitance CRES is provided across the parallel connection of the lamps and their respective series capacitors CL1, CL2, CL3 and CL4.

Each lamp is of the instant start type which does not require filament preheating. The integrated circuit 10 includes all necessary lamp control functions, including lamp presence detection, ignition timing and automatic lamp restart, for correctly driving multiple lamp configurations. These functions and circuits are known to those of skill in the art. Integrated circuit 10 provides pulse width modulated gate signals to the switching transistors MHS and MLS which are filtered by the resonance circuit comprising the respective inductors and capacitors to provide a substantially sinusoidal waveform to each lamp.

According to the invention, the output voltage across output capacitor CRES is driven to a defined constant voltage in order to insure ignition of all lamps. Further, brightness of each lamp is maintained at a substantially constant level even if a lamp is removed from the circuit. Additionally, non-zero voltage switching is reduced to prevent switch failure.

Figure 2:
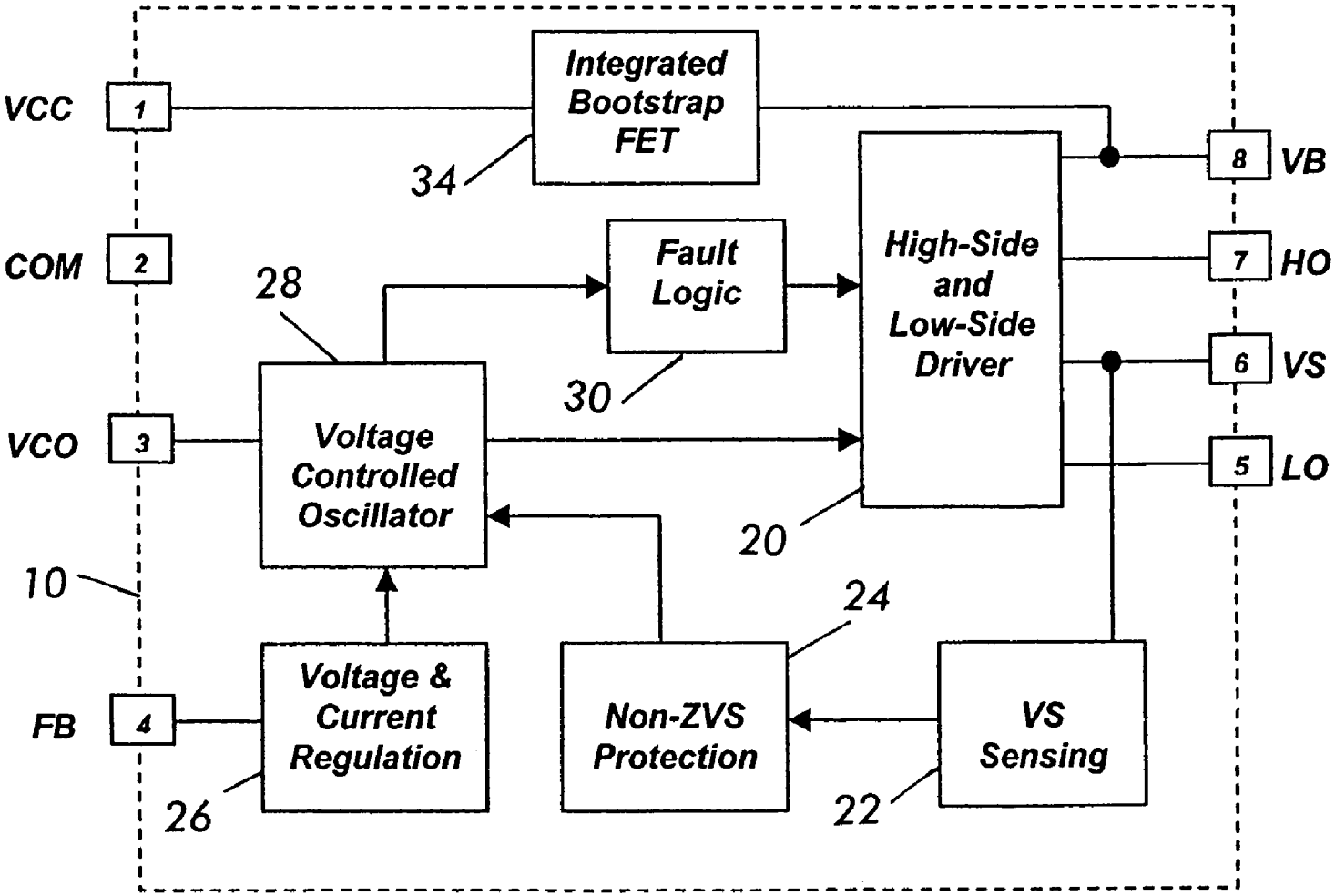
FIG. 2 shows the block diagram of the ballast control integrated circuit shown in FIG. 1.

FIG. 2 shows a block diagram of the control integrated circuit in more detail. Turning now to FIG. 2, a block diagram of the ballast control integrated circuit 10 is shown. The circuit includes a high side and low side driver 20 providing HO and LO outputs for driving the power switches MHS and MLS. Pin VS is connected to the switched node of the power transistors. A VS sensing circuit 22 senses the voltage at node VS when the LO output goes high. Accordingly, VS normally will be low when the LO output goes high in the absence of hard switching. This voltage is used to drive non-zero voltage switching protection circuit 24. The non-zero voltage protection circuit 24 is utilized to control a voltage controlled oscillator 28, and described in greater detail herein. Furthermore, a feedback pin FB is used to monitor the output voltage to provide control of the VCO to ensure that all lamps ignite by maintaining a constant output voltage. Furthermore, the FB pin is used to control the VCO to provide substantially constant current to each lamp to maintain substantially constant lamp brightness, even if a lamp is removed. Should all lamps be removed, the lamp resonant tank output circuit will be interrupted causing the half-bridge output to go open circuit which will cause capacitive switching, resulting in high peak MOSFET currents that can damage them. The voltage controlled oscillator 28 will increase the frequency to attempt to satisfy zero voltage switching until the VCO pin decreases below a threshold, at which point the integrated circuit will enter fault mode via fault logic 30 and latch the LO and HO gate driver outputs low for turning the half bridge off safely before any damage can occur to the MOSFETs.

The integrated circuit 10 also includes an integrated bootstrap FET 34 acting as the bootstrap diode which is coupled to VCC and supplies the high side driver voltage supply. The high side driver is contained in a high voltage well, isolated from the low side circuitry.

Figure 3:
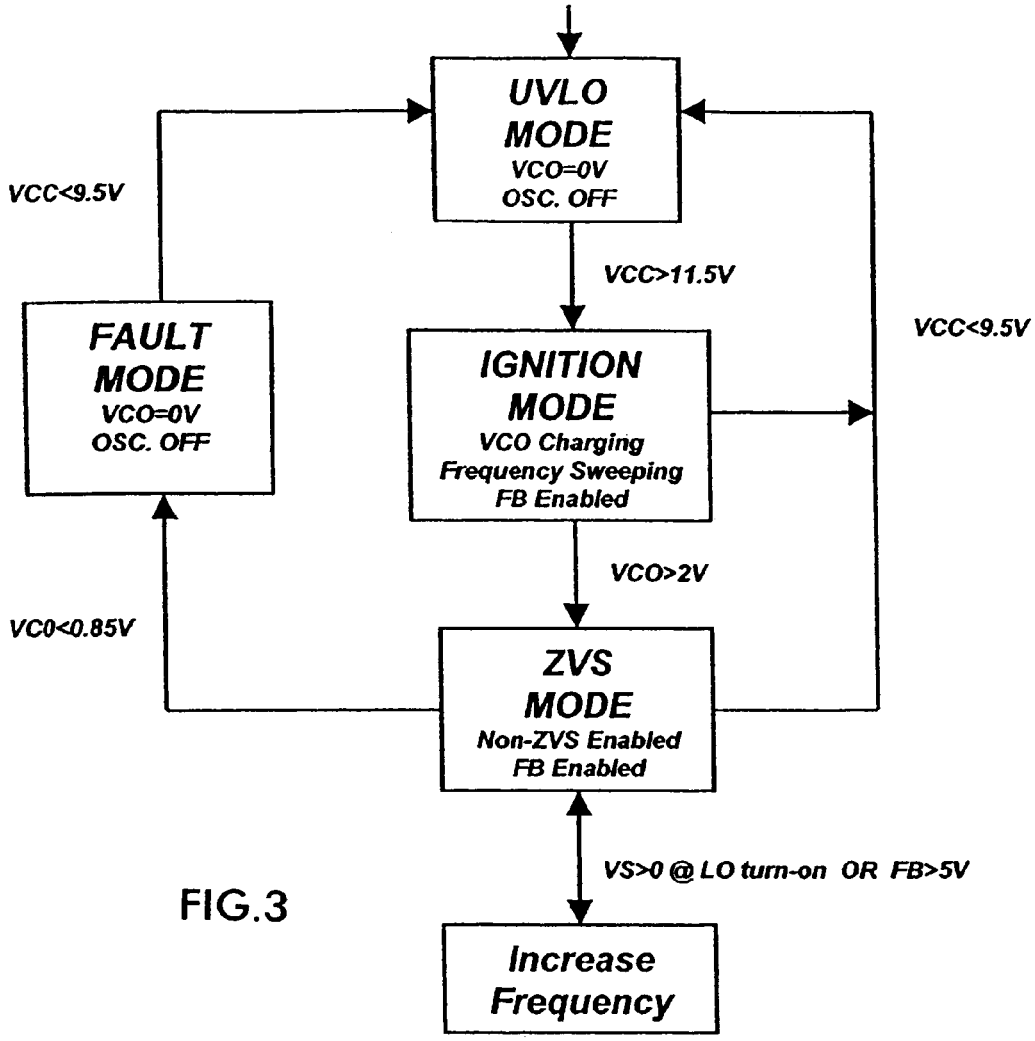
FIG. 3 shows the state diagram of the integrated circuit.

FIG. 3 shows the state diagram for the IC 10, showing that there are four modes, UVLO (under voltage lockout mode), ignition mode, ZVS (zero-voltage switching) run mode and fault mode. If non-zero voltage switching is detected the frequency is increased to drive the ballast back to ZVS.

Turning again to FIG. 1, the circuit for driving the output voltage across capacitor CRES to a constant voltage to ensure that all lamps ignite will now be described. A voltage divider resistor ladder composed of R1, R2, R3, and R4 produces a measurement of the sinusoidal voltage across the resonant capacitor CRES. This voltage is then filtered through a series-connected coupling capacitor CV such that the DC component is blocked and only the sinusoidal AC voltage portion of the output voltage waveform appears on the FB pin.

Figure 4:
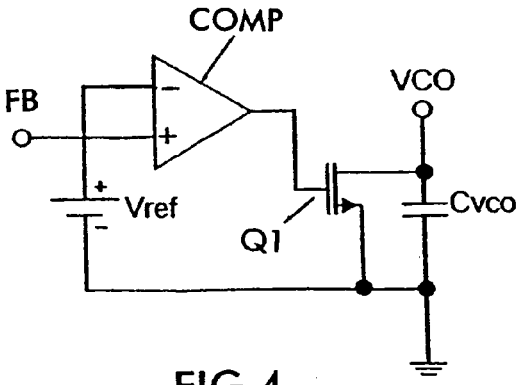
FIG. 4 shows a portion of the IC internal circuitry for constant output voltage control.

A comparator COMP inside the IC, which is connected to the FB pin, will then compare this input against a fixed voltage reference inside. This is shown in FIG. 4.

Each switching cycle, when the peak of the AC voltage waveform on the FB pin exceeds the reference voltage VREF, the comparator COMP will pull down the VCO slightly via $Q_1$ and increase the running frequency slightly. This will cause the operating point on the resonance curve to move down the curve slightly (higher frequency) which will then decrease the gain of the resonance circuit slightly and decrease the output voltage across capacitor CRES. This cycle-by-cycle negative feedback will keep the output voltage across capacitor CRES maintained at a constant level. Adjusting the resistor values of the resistor voltage divider ladder formed by R1, R2, R3 and R4 can externally program the voltage level across capacitor CRES. The constant voltage level across CRES is programmed high enough to strike the lamps. When a lamp is ignited, the value of the capacitors in series with each lamp (CL1, CL2, CL3, CL4) determines the correct working current and voltage for the lamps. When a lamp is removed, the voltage across CRES will change momentarily but will be pulled back to the programmed voltage as the closed-loop circuit adjusts the frequency.

Although a comparator COMP is shown, other methods could be used, including an op amp that continuously steers the VCO voltage to continuously steer the VCO frequency and continuously regulate output voltage.

Figure 5:
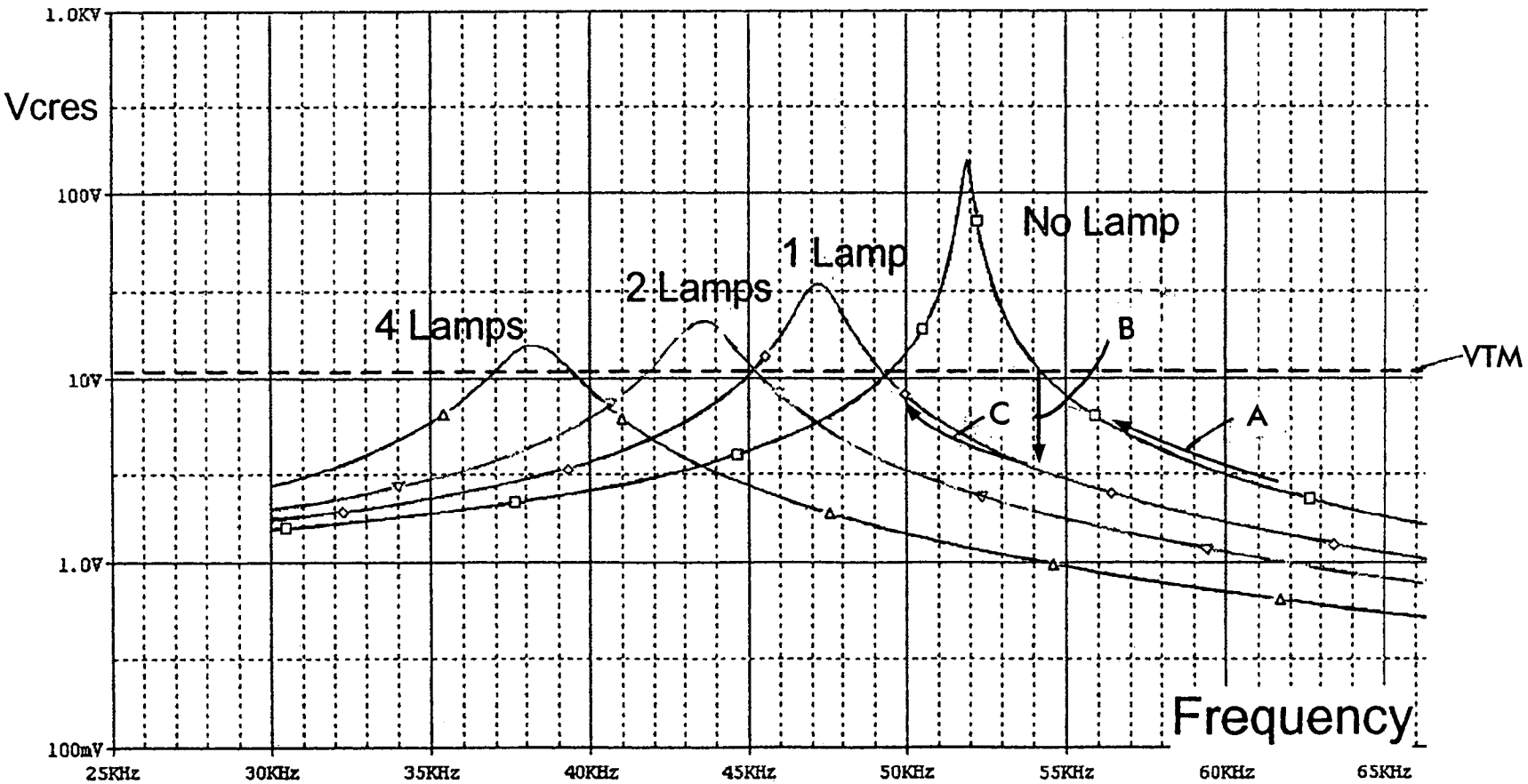
FIG. 5 shows transfer function graphs during lamp ignition.

FIG. 5 shows the sequence of igniting the lamps with this constant voltage control method. When the IC 10 is enabled and the frequency ramps down for the first time (arrow A), the voltage across output capacitor CRES ramps up to the voltage limit set by the constant voltage loop. The voltage is above the lamp ignition voltage threshold VTH. When the first lamp ignites, the resonance point of the circuit moves to a lower frequency and the operating point is located on the new curve but at a lower gain (arrow B). The CRES voltage decreases sharply and the constant voltage loop reacts by decreasing the frequency further to increase the CRES voltage again (arrow C). When the voltage reaches a high enough level above VTH, the next lamp ignites and the resonance point decreases again. By repeating this sequence, as shown, all of the lamps will eventually be ignited and the constant voltage loop will regulate the CRES voltage to the programmed level.

When a lamp is turned on, the capacitor CL1, CL2, CL3, CL4, etc. in series with that lamp can be programmed to supply the correct working current and voltage to the lamp. However, as the working point changes according to the number of the lamps connected, the impedance of the capacitors changes accordingly. This results in changing the working current, thus the light output of the lamps.

Figure 6:
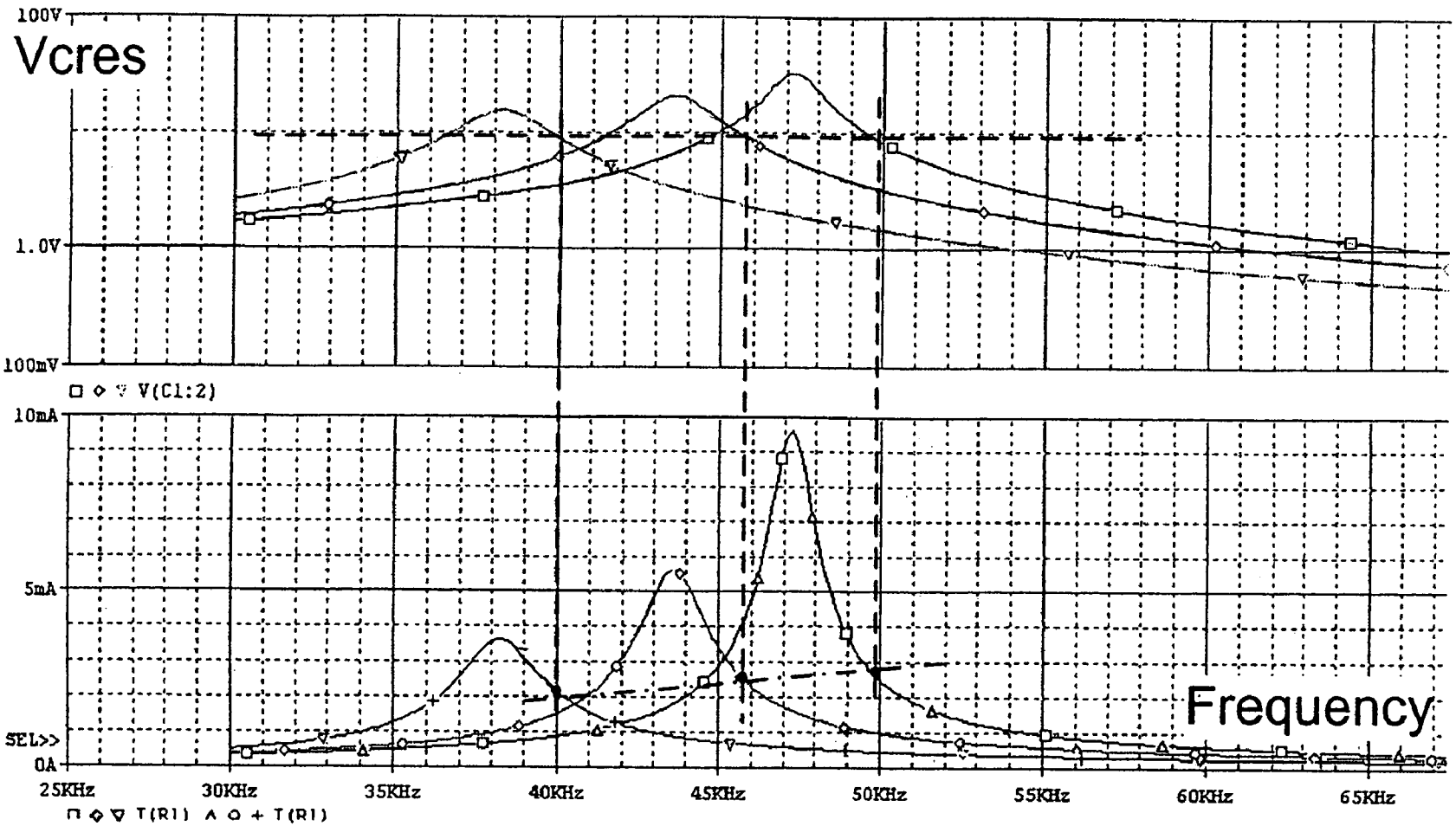
FIG. 6 shows transfer function graphs for the circuit of FIG. 1 related to output voltage control.

FIG. 6 shows that even if the voltage across CRES is controlled, the lamp current will change depending on how many lamps are present in the circuit.

It is thus also necessary to control the current to the lamps to keep the brightness of each lamp constant.

The constant voltage control described above assumes the impedance of capacitors CL1, CL2, CL3 or CL4 does not change. However, when a lamp is removed, the resonance frequency of the output circuit shifts to a higher frequency and the non-ZVS protection circuit 24 will increase the operating frequency to maintain soft switching. Conversely, when a lamp is inserted, the resonance frequency of the output circuit shifts to a lower frequency and the constant voltage control circuit will decrease the operating frequency to keep the output voltage constant. These changes in the operating frequency cause the impedance of CL1, CL2, CL3 and CL4 to change and result in an undesired change in the lamp current, and therefore the light output, of the lamps.

To solve this problem, a dummy load comprised of capacitor CL and resistor RL is used to generate an equivalent measurement of the current from a single lamp. A current sensing resistor in series with the lamps cannot be used because as lamps are removed and inserted, the lamp current information becomes lost. Using an equivalent dummy load with the resistor RL matching the impedance of a single lamp that is always connected in the circuit ensures that the lamp current will always be present to be fed back to the regulation circuit. The equivalent dummy load circuit formed by CL and RL generates a voltage on RL that is proportional to the lamp current. Diode D1 rectifies the signal, and RF and C1 filter and average the signal so that it then becomes a positive DC signal. The DC signal then goes through a pull-up resistor, RPULL, to IC terminal FB, across which is coupled capacitor CFB. Also note that the DC blocking capacitor CV, which provides the AC value of the output voltage arrow CRES, is also coupled to the same point FB.

Figure 7:
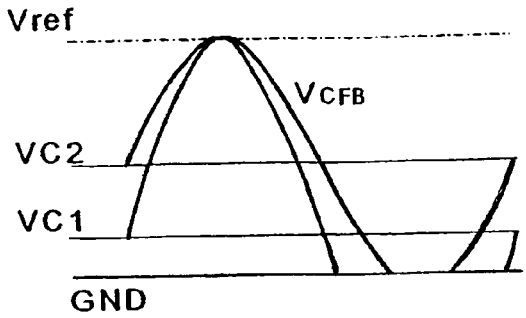
FIG. 7 shows waveforms at the FB pin of the control IC.

Connected in this manner, the circuit combines the lamp current and output voltage measurements together at a single pin FB on the IC 10. The DC component (e.g., VC1, VC2) of the signal represents the lamp current, and the AC component represents the output voltage, as shown in FIG. 7. The circuit uses capacitor CV as a coupling capacitor to superimpose the AC signal on the DC signal at the FB pin. This simplifies the voltage and current control loops and utilizes only a single pin on the IC for sensing both measurements. When the DC voltage (lamp current) on C1 increases, the amplitude of the AC component (output voltage) will decrease. This is shown in FIG. 7. When the DC level increases from VC1 to VC2, the amplitude of the AC voltage across CFB decreases. This means that when the current in the lamp is high (VC2, for example), the voltage across CRES is controlled lower, so the current will be reduced and vice versa. The circuit is now able to control the output of each lamp to be substantially constant.

A zener diode D2 is preferably connected in parallel with RL to limit the DC voltage feedback to C1. D2 is programmed to insure there is always enough voltage on CRES to ignite the next lamp.

Figure 8:
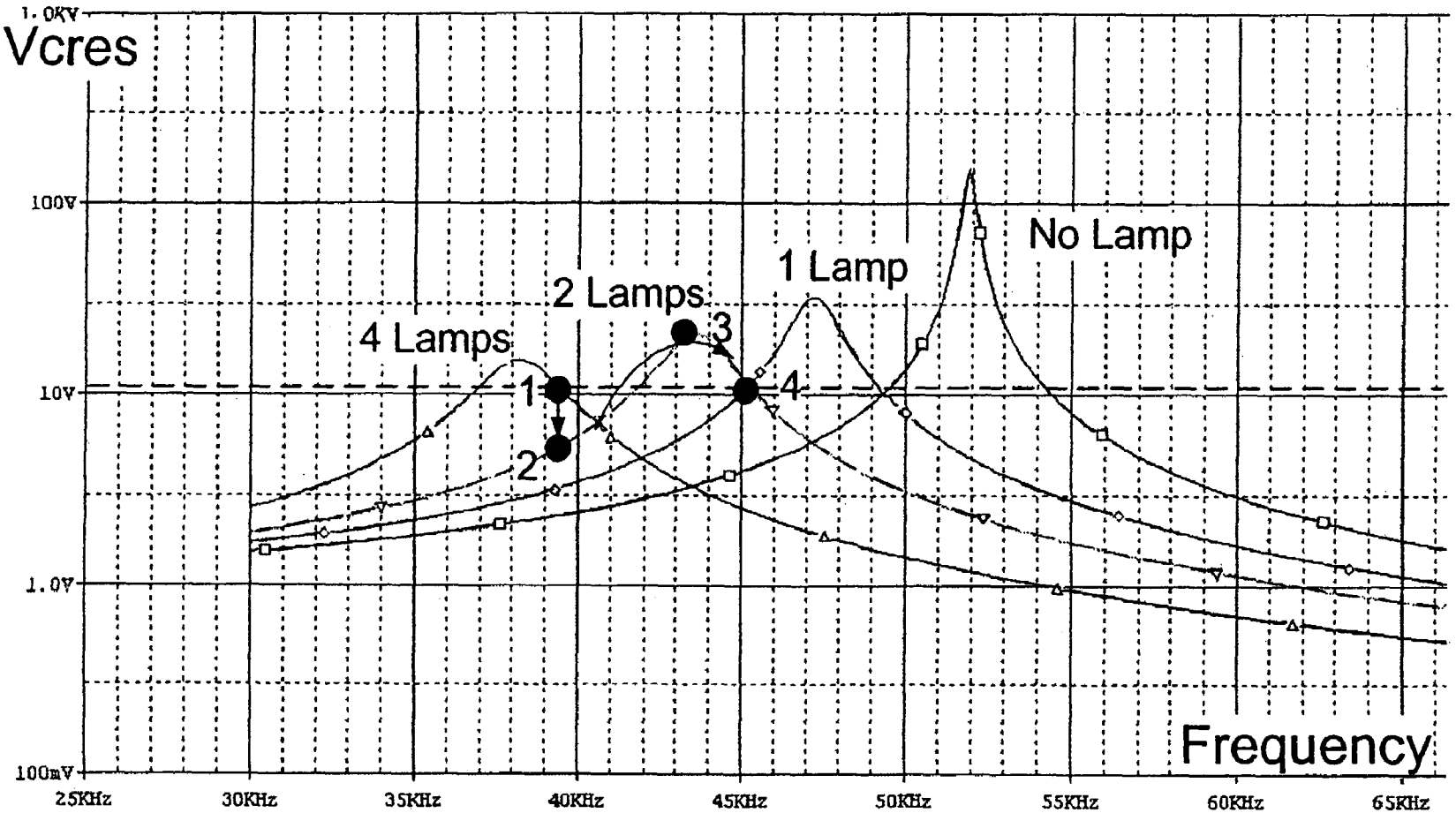
FIG. 8 shows transfer function graphs related to non-ZVS protection.

When the VCO 28 voltage at VCO exceeds 2V for the first time, the non-ZVS (non zero-voltage switching) protection is activated. The non-ZVS protection circuit 24 detects the voltage waveform at the VS pin via VS sensing circuit 22 just before LO is turned on each switching cycle (see FIG. 2). If the voltage at VS is above zero at the turn-on of each cycle of the LO gate drive signal, this corresponds to non-ZVS which results in hard-switching of the half-bridge. VS sensing is enabled when LO is high. The non-ZVS protection circuit then increases the frequency by decreasing the VCO voltage slightly until the circuit operates on the inductive side of resonance and soft-switching ZVS is achieved. The discharging of the VCO capacitor CVCO is designed to be fast so that the circuit quickly reacts to hard switching and moves to the inductive side of resonance within a certain amount of switching cycles to maintain soft switching before any damage occurs to the half-bridge MOSFETs. With non-ZVS protection working in this manner, the circuit will maintain ZVS as lamps are removed from the circuit. When a lamp is removed, the resonance point of the circuit moves higher in frequency causing the operating point to fall below resonance. The non-ZVS circuit 24 will automatically keep adjusting the frequency to keep the operating point above resonance for maintaining ZVS. This is shown in FIG. 8.

When a lamp is removed, non-ZVS hard switching is very likely to occur if the VCO frequency is not shifted higher. In FIG. 8, the circuit will operate at point 1 when there are 4 lamps; however, when 2 lamps are suddenly removed, the frequency does not change and the operating point drops to point 2, which is on the capacitive side of the transfer curve and which will cause non-ZVS hard switching. While the voltage is lower than the threshold, the constant voltage control will not try to increase the frequency in this case.

The non-ZVS protection circuit 24 integrated in the IC will then function. The circuit measures the VS voltage every cycle when LO is turned on. If VS is above zero at the rising edge when LO is turned on, the VCO will be discharged slightly to increase the frequency. Cycle by cycle, the working point will then move to point 3, which is just to the right of the peak of the resonance point on the inductive side.

As soon as the voltage across capacitor CRES goes above the threshold, the constant voltage control will increase the frequency further to move the working point to point 4, which gives the right working condition for the lamp load.

The multiple-lamp instant start ballast control circuit according to the invention thus includes the following features, amongst others:

1. Fast frequency sweep for instant start lamps. Instant start lamps do not require preheat so what is required is to sweep the frequency from a high-frequency above resonance to a lower frequency near resonance which will create an ignition voltage ramp for igniting the lamp.

By choosing a small enough CVCO capacitor, the ramp up time can be fast enough for instant start lamps, and the ramp up function causes less stress on the lamp filament while making sure that all the lamps will be ignited.

2. Non-ZVS protection. In a conventional design, when a lamp is removed, hard switching is very likely to occur and damage MOSFETs, drivers or even lamps. The non-ZVS protection circuit provides an integrated solution for this problem and keeps the circuit in a safe operating region above resonance as lamps are removed or inserted into the output circuit.

3. Combined voltage and current control. The voltage control insures that all lamps are successfully ignited. The combination of voltage and current control maintains constant brightness control when lamps are removed or replaced. This is important for instant start lamp applications where a single ballast can be used to drive multiple lamps (4 typically). As lamps are removed or replaced, the lamps should always maintain the same brightness level. The combination of voltage and current control will achieve this.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A ballast control circuit for a plurality of parallel connected lamps, the circuit comprising:

a control circuit for driving two series connected switches of a lamp ballast connected across a supply potential and having a switched node between the switches, the switched node adapted to be connected to each of the plurality of parallel connected lamps, the control circuit comprising an oscillator;

an output circuit comprising the plurality of parallel connected lamps including inductive and capacitive components and having a resonance frequency that is dependent on the number of lamps in the output circuit, an output voltage being developed across the output circuit; and a feedback circuit for controlling the oscillator whereby the oscillator sweeps from a first frequency above the resonance frequency to a lower frequency closer to the resonance frequency such that the output voltage increases to a potential above a lamp ignition threshold, thereby igniting at least one lamp, the feedback circuit controlling the oscillator whereby the oscillator frequency reduces each time a lamp ignites, causing the output voltage across the output voltage circuit to increase above the threshold, thereby igniting another of the lamps.

2. The ballast control circuit of claim 1, wherein the feedback circuit comprises a circuit for driving the output voltage to a substantially constant voltage.

3. The ballast control circuit of claim 2, wherein the feedback circuit comprises a voltage sensing circuit coupled across the output circuit and an oscillator control circuit receiving an output of the voltage sensing circuit for generating an output to increase the oscillator frequency when the output voltage increases above a threshold thereby to maintain a substantially constant voltage across said output circuit.

4. The ballast control circuit of claim 3, wherein the oscillator control circuit comprises a comparator receiving at one input an output of the voltage sensing circuit and at a second input a reference voltage.

5. The ballast control circuit of claim 3, wherein the feedback circuit decreases the oscillator frequency to increase the output voltage each time a lamp ignites, and the output voltage decreases, thereby increasing the output voltage until the next lamp ignites.

6. The ballast control circuit of claim 5, wherein the oscillator comprises a voltage controlled oscillator receiving a voltage from said feedback circuit across a capacitance for determining the oscillator frequency.

7. The ballast control circuit of claim 1, further comprising a circuit for maintaining a substantially constant current to each lamp including when a lamp is removed.

8. The ballast control circuit of claim 7, wherein the circuit for maintaining a substantially constant current comprises: an equivalent load circuit disposed across the output circuit providing an equivalent current to the current drawn by a single ignited lamp, thereby providing a feedback voltage to the feedback circuit at all times.

9. The ballast control circuit of claim 8, further wherein the equivalent load circuit provides a DC voltage proportional to lamp current, and further wherein said DC voltage proportional to lamp current and the output of said feedback circuit are coupled together, whereby when the lamp current increases, said output of the feedback circuit decreases, thereby reducing the output voltage and reducing the current in each lamp to maintain each lamp at a substantially constant current.

10. The ballast control circuit of claim 9, further wherein when said lamp current decreases, said output of the feedback circuit increases, thereby increasing the output voltage and increasing the current in each lamp to maintain each lamp at a substantially constant current.

11. The ballast control circuit of claim 10, wherein, when the feedback circuit output increases, the frequency of said oscillator decreases and vice versa.

12. The ballast control circuit of claim 1, further comprising a circuit for reducing hard switching when a lamp is removed from the output circuit.

13. The ballast control circuit of claim 12, wherein said circuit for reducing hard switching comprises a circuit for sensing when non-zero voltage switching of said switches occurs, said sensing circuit monitoring a potential on said switched node when one of said switches comprising a low side switch is turned on, said sensing circuit coupled to said oscillator and operating to increase the frequency of said oscillator above the resonance frequency when non-zero voltage switching occurs thereby to achieve zero voltage switching.

14. The ballast control circuit of claim 13, whereby said sensing circuit at least partly discharges a capacitor of said oscillator to increase the frequency of said oscillator.

15. The ballast control circuit of claim 14 wherein, when a lamp is removed from said output circuit, the impedance of said output circuit increases causing the resonance frequency to increase and non-zero voltage switching to occur, said sensing circuit sensing a voltage on said switched node and operating to increase the frequency of said oscillator thereby to achieve zero voltage switching.

16. The ballast control circuit of claim 1, wherein said feedback circuit at least partly discharges a capacitor of said oscillator to increase the frequency of said oscillator.

17. The ballast control circuit of claim 1, wherein the lamps are instant start gas discharge lamps.

18. A ballast control circuit for a plurality of parallel connected lamps, the circuit comprising:

a control circuit for driving two series connected switches of a lamp ballast connected across a supply potential and having a switched node between the switches, the switched node adapted to be connected to the plurality of parallel connected lamps, the control circuit comprising an oscillator;

an output circuit comprising the plurality of parallel connected lamps including inductive and capacitive components and having a resonance frequency that is dependent on the number of lamps in the output circuit, an output voltage being developed across the output circuit;

a circuit for reducing hard switching when a lamp is removed from the output circuit; and a feedback circuit comprising a voltage sensing circuit coupled across the output circuit and an oscillator control circuit receiving an output of the voltage sensing circuit for generating the output voltage to increase the oscillator frequency when the output voltage increases above a threshold thereby to maintain a substantially constant voltage across said output circuit, wherein the feedback circuit decreases the oscillator frequency to increase the output voltage each time a lamp ignites, and the output voltage decreases, thereby increasing the output voltage until the next lamp ignites.

19. The ballast control circuit of claim 18, wherein the oscillator control circuit comprises a comparator receiving at one input an output of the voltage sensing circuit and at a second input a reference voltage.

20. The ballast control circuit of claim 18, wherein the oscillator comprises a voltage controlled oscillator receiving a voltage from said feedback circuit across a capacitance for determining the oscillator frequency.

21. The ballast control circuit of claim 18, further comprising a circuit for maintaining a substantially constant current to each lamp including when a lamp is removed.

22. The ballast control circuit of claim 21, wherein the circuit for maintaining a substantially constant current comprises: an equivalent load circuit disposed across the output circuit providing an equivalent current to the current drawn by a single ignited lamp, thereby providing a feedback voltage to the feedback circuit at all times.

23. The ballast control circuit of claim 22, further wherein the equivalent load circuit provides a DC voltage proportional to lamp current, and further wherein said DC voltage proportional to lamp current and the output of said feedback circuit are coupled together, whereby when the lamp current increases, said output of the feedback circuit decreases, thereby reducing the output voltage and reducing the current in each lamp to maintain each lamp at a substantially constant current.

24. The ballast control circuit of claim 23, further wherein when said lamp current decreases, said output of the feedback circuit increases thereby increasing the output voltage and increasing the current in each lamp to maintain each lamp at a substantially constant current.

25. The ballast control circuit of claim 24, wherein, when the feedback circuit output increases, the frequency of said oscillator decreases and vice versa.

26. The ballast control circuit of claim 18, wherein said circuit for reducing hard switching comprises a circuit for sensing when non-zero voltage switching of said switches occurs, said sensing circuit monitoring a potential on said switched node when one of said switches comprising a low side switch is turned on, said sensing circuit coupled to said oscillator and operating to increase the frequency of said oscillator above the resonance frequency when non-zero voltage switching occurs thereby to achieve zero voltage switching.

27. The ballast control circuit of claim 26, whereby said sensing circuit at least partly discharges a capacitor of said oscillator to increase the frequency of said oscillator.

28. The ballast control circuit of claim 27, wherein, when a lamp is removed from said output circuit, the impedance of said output circuit increases causing the resonance frequency to increase and non-zero voltage switching to occur, said sensing circuit sensing a voltage on said switched node and operating to increase the frequency of said oscillator thereby to achieve zero voltage switching.

29. The ballast control circuit of claim 18, wherein said feedback circuit at least partly discharges a capacitor of said oscillator to increase the frequency of said oscillator.

30. The ballast control circuit of claim 18, wherein the lamps are instant start gas discharge lamps.

31. A ballast control circuit for multiple lamps comprising:

a control circuit for driving two series connected switches of a lamp ballast connected across a supply potential and having a switched node between the switches; the switched node adapted to be connected to an output circuit comprising a plurality of parallel connected lamps; the control circuit comprising an oscillator, the output circuit comprising the plurality of parallel connected lamps including inductive and capacitive components and having a resonance frequency that is dependent on the number of lamps in the output circuit; an output voltage being developed across the output circuit;

further comprising:

a circuit for reducing hard switching when a lamp is removed from the output circuit, said circuit for reducing hard switching comprising a circuit for sensing when non-zero voltage switching of said switches occurs, said sensing circuit monitoring a potential on said switched node when one of said switches comprising a low side switch is turned on, said sensing circuit coupled to said oscillator and operating to increase the frequency of said oscillator above the resonance frequency when non-zero voltage switching occurs thereby to achieve zero voltage switching.

32. The ballast control circuit of claim 31, further comprising a feedback circuit comprising a circuit monitoring the output voltage for driving the lamp output voltage to a substantially constant voltage.

33. The ballast control circuit of claim 32, wherein the feedback circuit comprises a voltage sensing circuit coupled across the output circuit and an oscillator control circuit receiving an output of the voltage sensing circuit for generating an output to increase the oscillator frequency when the output voltage increases above a threshold thereby to maintain a substantially constant voltage across said output circuit.

34. The ballast control circuit of claim 33, wherein the oscillator control circuit comprises a comparator receiving at one input an output of the voltage sensing circuit and at a second input a reference voltage.

35. The ballast control circuit of claim 33, wherein the feedback circuit decreases the oscillator frequency to increase the output voltage each time a lamp ignites, and the output voltage decreases thereby increasing the output voltage until the next lamp ignites.

36. The ballast control circuit of claim 35, wherein the oscillator comprises a voltage controlled oscillator receiving a voltage from said feedback circuit across a capacitance for determining the oscillator frequency.

37. The ballast control circuit of claim 32, further comprising a circuit for maintaining a substantially constant current to each lamp including when a lamp is removed.

38. The ballast control circuit of claim 37, wherein the circuit for maintaining a substantially constant current comprises:

an equivalent load circuit disposed across the output circuit providing an equivalent current to the current drawn by a single ignited lamp, thereby providing a feedback voltage to the feedback circuit at all times.

39. The ballast control circuit of claim 38, further wherein the equivalent load circuit provides a DC voltage proportional to lamp current, and further wherein said DC voltage proportional to lamp current and the output of said feedback circuit are coupled together, whereby when the lamp current increases, said output of the feedback circuit decreases, thereby reducing the output voltage and reducing the current in each lamp to maintain each lamp at a substantially constant current.

40. The ballast control circuit of claim 39, further wherein when said lamp current decreases, said output of the feedback circuit increases thereby increasing the output voltage and increasing the current in each lamp to maintain each lamp at a substantially constant current.

41. The ballast control circuit of claim 40, wherein, when the feedback circuit output increases, the frequency of said oscillator decreases and vice versa.

42. The ballast control circuit of claim 31, whereby said sensing circuit at least partly discharges a capacitor of said oscillator to increase the frequency of said oscillator.

43. The ballast control circuit of claim 31, wherein said feedback circuit at least partly discharges a capacitor of said oscillator to increase the frequency of said oscillator.

44. The ballast control circuit of claim 31 wherein, when a lamp is removed from said output circuit, the impedance of said output circuit increases causing the resonance frequency to increase and non-zero voltage switching to occur, said sensing circuit sensing a voltage on said switched node and operating to increase the frequency of said oscillator thereby to achieve zero voltage switching.

45. The ballast control circuit of claim 31, wherein the lamps are instant start gas discharge lamps.

46. A ballast control integrated circuit for driving two series connected switches of a lamp ballast connected across a supply potential and having a switched node between the switches; the switched node adapted to be connected to each of a plurality of parallel connected lamps, the control integrated circuit comprising:

an oscillator;

an output circuit comprising the plurality of parallel connected lamps including inductive and capacitive components and having a resonance frequency that is dependent on the number of lamps in the output circuit, a lamp output voltage being developed across the output circuit; and a feedback circuit comprising a circuit monitoring the output voltage for driving the lamp output voltage to a substantially constant voltage, the feedback circuit comprising an oscillator control circuit generating the output voltage to increase the oscillator frequency when the output voltage increases above a threshold thereby to maintain a substantially constant voltage across said output circuit, wherein the feedback circuit decreases the oscillator frequency to increase the output voltage each time a lamp ignites, and the output voltage decreases, thereby increasing the output voltage until the next lamp ignites.

47. The ballast control integrated circuit of claim 46, wherein the oscillator control circuit comprises a comparator receiving at one input an output coupled to the output voltage and at a second input a reference voltage.

48. The ballast control integrated circuit of claim 46, wherein the oscillator comprises a voltage controlled oscillator receiving a voltage from said feedback circuit across a capacitance for detennining an oscillator frequency.

49. The ballast control integrated circuit of claim 46, wherein said feedback circuit at least partly discharges a capacitor of said oscillator to increase the frequency of said oscillator.

50. The ballast control integrated circuit of claim 46 comprising a package having no more than 8 pins.

51. A ballast control integrated circuit for driving two series connected switches of a lamp ballast connected across a supply potential and having a switched node between the switches; the switched node adapted to be connected to an output circuit comprising a plurality of parallel connected lamps; the control integrated circuit comprising:

an oscillator, the output circuit comprising the plurality of parallel connected lamps including inductive and capacitive components and having a resonance frequency that is dependent on the number of lamps in the output circuit; an output voltage being developed across the output circuit; and a circuit for reducing hard switching when a lamp is removed from the output circuit, said circuit for reducing hard switching comprising a circuit for sensing when non-zero voltage switching of said switches occurs, said sensing circuit monitoring a potential on said switched node when one of said switches comprising a low side switch is turned on, said sensing circuit coupled to said oscillator and operating to increase the frequency of said oscillator above the resonance frequency when non-zero voltage switching occurs thereby to achieve zero voltage switching.

52. The ballast control integrated circuit of claim 51, whereby said sensing circuit at least partly discharges a capacitor of said oscillator to increase the frequency of said oscillator.

53. The ballast control integrated circuit of claim 51, wherein, when a lamp is removed from said output circuit, the impedance of said output circuit increases causing the resonance frequency to increase and non-zero voltage switching to occur, said sensing circuit sensing a voltage on said switched node and operating to increase the frequency of said oscillator thereby to achieve zero voltage switching.

54. The ballast control integrated circuit of claim 51 comprising a package having no more than 8 pins.

55. The ballast control circuit of claim 51, wherein the lamps are instant start gas discharge lamps.

56. A ballast control circuit for a plurality of parallel connected lamps, the circuit comprising:

a control circuit for driving two series connected switches of a lamp ballast connected across a supply potential and having a switched node between the switches, the switched node adapted to be connected to each of the plurality of parallel connected lamps, the control circuit comprising an oscillator an output circuit comprising the plurality of parallel connected lamps including inductive and capacitive components and having a resonance frequency that is dependent on the number of lamps in the output circuit, a resonant output voltage being developed across the output circuit;

a feedback circuit comprising a circuit monitoring the resonant output voltage for driving the lamp output voltage to a substantially constant voltage, the feedback circuit converting the resonant output voltage to an AC voltage; and a circuit for maintaining a substantially constant current to each lamp including when a lamp is removed, said circuit providing a DC voltage proportional to lamp current, and further wherein said DC voltage proportional to lamp current and the AC voltage from said feedback circuit are superimposed to provide a single feedback signal for controlling the frequency of said oscillator, whereby when the lamp current increases, said output of the feedback circuit decreases, thereby reducing the output voltage and reducing the current in each lamp to maintain each lamp at a substantially constant current.

57. The ballast control circuit of claim 56, wherein the circuit for maintaining a substantially constant current comprises an equivalent load circuit disposed across the output circuit providing an equivalent current to the current drawn by a single ignited lamp, thereby providing a feedback voltage to the feedback circuit at all times.

* * * * *